US012134894B2

(12) United States Patent
Fermanian

(10) Patent No.: US 12,134,894 B2
(45) Date of Patent: Nov. 5, 2024

(54) FOAM AS MODULAR SUPPORT

(71) Applicant: Lazarian World Homes, Oceanside, CA (US)

(72) Inventor: George Fermanian, Oceanside, CA (US)

(73) Assignee: LAZARIAN WORLD HOMES, Eagle, ID (US)

( * ) Notice: Subject to any disclaimer, the term of this patent is extended or adjusted under 35 U.S.C. 154(b) by 0 days.

(21) Appl. No.: 17/860,689

(22) Filed: Jul. 8, 2022

(65) Prior Publication Data

US 2022/0389711 A1 Dec. 8, 2022

Related U.S. Application Data

(63) Continuation-in-part of application No. 17/101,524, filed on Nov. 23, 2020, now Pat. No. 11,408,173.
(Continued)

(51) Int. Cl.
*E04C 1/39* (2006.01)
*E04B 2/02* (2006.01)
(Continued)

(52) U.S. Cl.
CPC ..... *E04C 1/39* (2013.01); *E04B 2/18* (2013.01); *E04B 2/24* (2013.01); *E04B 2002/0228* (2013.01); *E04B 2002/0256* (2013.01)

(58) Field of Classification Search
CPC ..... E04C 1/41; E04C 1/39; E04B 2/18; E04B 2/26; E04B 2002/0208; E04B 2002/0217;
(Continued)

(56) References Cited

U.S. PATENT DOCUMENTS 979,913 A ‡ 12/1910 Ault ..... E04B 2/18 52/591.1
1,418,168 A ‡ 5/1922 Preston ..... E04B 2/14 52/591.5

(Continued)

FOREIGN PATENT DOCUMENTS

WO WO-2015089099 A1 * 6/2015 ..... E04B 2/18

OTHER PUBLICATIONS

Homerepairexpert.com. How Do You Cut Concrete Blocks? archived Internet copy from Oct. 8, 2013 (Oct. 8, 2013) retrieve from the Internet. retrieved on [Feb. 6, 2015] URL: https//web.archive.org/web/2013008100647/http://homerepairexpert.com/how-do-you-cut-concrete-blocks%3f>.

(Continued)

*Primary Examiner* — Rodney Mintz
(74) *Attorney, Agent, or Firm* — TROUTMAN PEPPER HAMILTON SANDERS LLP

(57) ABSTRACT

A polyurethane foam block can include a base having a plurality of recesses and a top surface having a plurality of connective components protruding outward from the top surface where each connective component of the plurality of connective components can align with a recess of the plurality of recesses. The polyurethane foam block can include a plurality of sidewalls extending upward from the base and defining an interior and a plurality of partitions extending from the base to the top surface to divide the block into a plurality of cavities. A wall can include base blocks and header blocks. The header blocks can be shaped and constructed similarly to the base blocks with one exception being the header blocks can include an-upward facing channel cutout. The wall can include a beam extending through channels of header blocks.

19 Claims, 9 Drawing Sheets

Related U.S. Application Data

(60) Provisional application No. 62/939,436, filed on Nov. 22, 2019.

(51) Int. Cl.
*E04B 2/18* (2006.01)
*E04B 2/24* (2006.01)

(58) Field of Classification Search
CPC ..... E04B 2002/0219; E04B 2/24; E04B 2002/0228; E04B 2002/0256; E04B 2002/0226
See application file for complete search history.

(56) References Cited

U.S. PATENT DOCUMENTS 2,319,203 A 5/1943 Branham
3,618,279 A 11/1971 Sease
4,475,326 A ‡ 10/1984 Hanson ..... A63H 33/084 52/286
4,614,071 A ‡ 9/1986 Sams ..... E04C 1/41 52/309.12
5,024,035 A ‡ 6/1991 Hanson ..... E04B 2/18 52/309.12
5,457,926 A ‡ 10/1995 Jensen ..... E04B 2/18 52/309.4
5,699,640 A ‡ 12/1997 Bourgeois ..... E04C 1/40 52/309.4
5,775,047 A ‡ 7/1998 Jensen ..... C04B 38/0051 106/672
5,839,249 A * 11/1998 Roberts ..... E04C 1/40 52/439
5,966,889 A ‡ 10/1999 Zinner ..... E04B 2/16 156/308.8
6,161,357 A ‡ 12/2000 Altemus ..... E04B 2/18 446/124
6,164,035 A * 12/2000 Roberts ..... E04B 1/14 52/745.1
6,848,228 B1 ‡ 2/2005 Williams ..... E04B 2/26 52/220.2
7,509,779 B2 ‡ 3/2009 Makovich ..... E04C 1/40 52/309.4
7,694,485 B1 4/2010 Siener
9,650,784 B2 ‡ 5/2017 Jensen ..... E04B 2/24
9,822,529 B1 ‡ 11/2017 Al-Salloum ..... E04C 1/41
9,834,932 B2 * 12/2017 Yesil ..... E04C 1/39
10,155,210 B2 ‡ 12/2018 Russell ..... B01J 8/24
10,781,588 B1 ‡ 9/2020 Nadeau ..... E04C 5/08
11,027,251 B2 ‡ 6/2021 Russell ..... E04B 2/16
11,408,173 B2 * 8/2022 Fermanian ..... E04B 2/26
11,686,063 B2 * 6/2023 Daggett ..... E04C 1/395 405/284
2005/0144877 A1 ‡ 7/2005 Williams ..... E04B 2/26 52/576
2005/0252134 A1 ‡ 11/2005 Makovich ..... E04C 1/41 52/503
2008/0066408 A1 ‡ 3/2008 Hileman ..... E04B 2/8647 52/414
2008/0216436 A1 ‡ 9/2008 Rodriguez ..... E04B 2/06 52/588.1
2009/0193740 A1 ‡ 8/2009 Bennett ..... E04C 1/40 52/309.4
2009/0217610 A1 ‡ 9/2009 Curtis ..... E04C 1/40 52/745.1
2010/0223876 A1 ‡ 9/2010 Jones ..... E04B 2/12 52/588.1
2011/0146186 A1 6/2011 Summers
2013/0036696 A1 ‡ 2/2013 Moroschan ..... E04B 2/16 52/309.4
2015/0218805 A1 ‡ 8/2015 Jensen ..... E04G 13/021 52/309.4
2015/0240485 A1 ‡ 8/2015 Yesil ..... E04B 5/026 52/309.13
2017/0080398 A1 ‡ 3/2017 Russell ..... E04B 2/16
2018/0290332 A1 ‡ 10/2018 Ross ..... B62B 3/002
2019/0054439 A1 ‡ 2/2019 Russell ..... B01J 8/24
2021/0156147 A1 * 5/2021 Fermanian ..... E04B 2/18
2021/0180283 A1 ‡ 6/2021 Daggett ..... E04C 1/395
2022/0081902 A1 * 3/2022 Leahy ..... E04B 2/16

OTHER PUBLICATIONS

"FERMBLOC—Build Model." YouTube, uploaded by Nick Fennel, Aug. 3, 2012, https://www.youtube.com/watch?v=zUsTmnAehLQ.

* cited by examiner
‡ imported from a related application

FOAM AS MODULAR SUPPORT

CROSS REFERENCE TO RELATED APPLICATION

This application is a continuation in part of U.S. patent application Ser. No. 17/101,524, filed Nov. 23, 2020, which claims priority under 35 U.S.C. § 119(e) to U.S. Provisional Patent Application No. 62/939,436, filed Nov. 22, 2019, the entire contents of each of which is hereby incorporated by reference as if fully set forth below.

FIELD OF DISCLOSURE

The present disclosure generally relates to a polyurethane foam block. In particular, the present disclosure relates to a method of forming a polyurethane foam block using a portable molding device and a method of stacking polyurethane foam blocks to form various structural entities including residential homes, commercial buildings, retaining walls and the like.

BACKGROUND

In many parts of the world, significant portions of the population reside in structures that do not provide adequate protection from weather elements. Although there have been advancements in building technology, providing affordable and resilient housing remains a challenge.

Traditional affordable housing solutions involve constructing structures out of modular foam components that can be stacked and filled with concrete and rebar to form various structures. The modular foam components can be manufactured and then shipped to a building site for assembly into a housing structure. When the building site is far away from the manufacturing site and/or inaccessible due to poor roads and infrastructure, the costs of shipping the modular foam components can be prohibitively expensive, due to the lightweight nature of foam.

Additionally, the modular foam components commonly include expanded polystyrene ("EPS") as the base material. However, EPS can present challenges due at least in part to its thermal resistance, moisture permeability, fire resistance, and ability to withstand high wind load, particularly as compared to polyurethane. Moreover, the traditional machinery used to create EPS modular components can be relatively bulky and heavy, thereby, making the ability to create such components with ease at a location in which a building or other stationary structure is built (e.g., a construction site) difficult. By way of example, the traditional machinery used to create EPS modular components can make it difficult to build walls, buildings, platforms, or other structural entities.

The solution of this disclosure resolves these and other problems within the prior art.

SUMMARY

These and other problems can be addressed by embodiments of the technology disclosed herein.

The disclosed technology can include a polyurethane foam block including a base having a plurality of recesses, a plurality of walls extending upward from the base where the plurality of walls define an interior, a top surface having a plurality of connective components protruding outward from the top surface, and a plurality of partitions extending from the base to the top surface to divide the block into a plurality of cavities. Each connective component of the plurality of connective components can align with a recess of the plurality of recesses. Each cavity can traverse a height of the block.

In some examples, the connective components can include at least six connective components. A center of each connective component of the plurality of connective components can be spaced apart from a center of an adjacent connective component by a distance of between approximately six inches and approximately ten inches.

In some examples, the plurality of recesses can include at least six recesses. A center of each recess of the plurality of recesses can be spaced apart from a center of an adjacent recess by a distance of between approximately six inches and approximately ten inches.

In some examples, each connective component of the plurality of connective components can be substantially frustoconical.

In some examples, each connective component of the plurality of connective components can include a top surface having a cut-out portion.

In some examples, the cut-out portion can have a length of between approximately four inches and approximately six inches and a width of between approximately four inches and approximately eight inches.

In some examples, a length and a width of a cross-section of each cut-out portion can be substantially the same as a length and a width of a cross-section of each recess.

In some examples, each recess can have a length of between approximately four inches and approximately six inches and a width of between approximately four inches and approximately eight inches.

In some examples, each cavity can have a volume of between approximately 300 cubic inches and approximately 800 cubic inches and can be configured to hold reinforcing material.

In some examples, the polyurethane foam block can include a two-component polymer system.

In some examples, at least one of the walls of the plurality of walls can be bevel.

The disclosed technology can include a wall of moldable foam blocks including a first row of moldable foam blocks positioned flush with a floor and a second row of moldable foam blocks positioned on top of the first row of moldable foam blocks. A plurality of recesses on a bottom surface of each moldable foam block in the second row can interlock with a plurality of connective components on a top surface of each moldable foam block in the first row.

In some examples, each moldable foam block can include moldable material having a thermal resistance R-value of between approximately five per inch and approximately six per inch.

In some examples, the second row of moldable foam blocks can be positioned on top of the first row of moldable foam blocks in a staggered configuration.

The disclosed technology can include a method of selectively stacking polyurethane foam blocks to create a stationary structure at a construction site including positioning a first polyurethane foam block flush with a floor where the polyurethane foam block can include a top surface with a plurality of connective components, a bottom surface with a plurality of recesses, a front surface, and a back surface. The method can include positioning a second polyurethane foam block flush with the floor where the second polyurethane foam block can include a top surface with a plurality of connective components and a bottom surface with a plurality of recesses, a front surface, and a back surface; aligning the front surface of the first polyurethane foam block with the back surface of the second polyurethane foam block such that the first polyurethane foam block and the second polyurethane foam block are substantially linear. The method can include positioning a third polyurethane foam block on top of the first polyurethane foam block and the second polyurethane block such that a plurality of recesses of the third polyurethane foam block can interlock with a portion of the plurality of connective components of the first polyurethane foam block and a portion of the plurality of connective components of the second polyurethane foam block.

In some examples, positioning the third polyurethane foam block on top of the first polyurethane foam block and the second polyurethane block such that a plurality of recesses of the third polyurethane foam block can interlock with a plurality of connective components of the first polyurethane foam block and the second polyurethane foam block can include aligning a first half of the plurality of recesses of the third polyurethane foam block with half of the first plurality of connective components of the first polyurethane foam block and aligning a second half of the plurality of recesses of the third polyurethane foam block with half of the plurality of connective components of the second polyurethane foam block such that the third polyurethane foam block can be staggered in relation to the first polyurethane foam block and the second polyurethane foam block.

In some examples, the method can further include filling a cavity traversing a height of the wall with reinforcing material.

In some examples, the method can further include forming the first polyurethane foam block, the second polyurethane foam block, and the third polyurethane foam block at the construction site.

In some examples, forming the first polyurethane foam block, the second polyurethane foam block, and the third polyurethane foam block at the construction site can include a) filling a container within a portable molding device with polyurethane, b) positioning a lid on the container, c) curing the polyurethane within the container for a predetermined period of time, d) removing the lid from the container, and e) ejecting the first polyurethane foam block from the container, and repeating steps a) through e) for the second polyurethane foam block and the third polyurethane foam block.

In some examples, the polymer foam block can include a polyurethane that has a thermal resistance R-value of between approximately 5 per inch and approximately 6 per inch.

The disclosed technology can include a wall including base blocks stacked to form a bottom portion of the wall and header blocks stacked on a top row of the base blocks. Each of the base blocks can have a bottom surface, a top surface, a front surface, a back surface, sidewalls, and cavities extending through each base block from the bottom surface of the base block to the top surface of the base block. The cavities can be aligned vertically across rows of the base blocks. Each of the header blocks can have a bottom surface configured to mate with the top surface of the base blocks, a front surface, a back surface, sidewalls, and an upward-facing channel positioned between the sidewalls of the header block. The base blocks and the header blocks can each include a polyurethane foam.

In some examples, the back surface of the header blocks can each have surface features configured to engage with a front surface of an adjacent header block.

In some examples, the back surface of the header blocks can each have a cutout shaped to a profile of the channel.

In some examples, the wall can further include a beam stop insert positioned at a front surface and/or a back surface of at least one of the header blocks within the cutout. The wall can include a beam stop insert at an end and/or corner of the wall.

In some examples, the header blocks can further include mating protrusions extending from a top surface of each of the sidewalls. The mating protrusions of the header blocks are aligned vertically aligned with the cavities of the base blocks.

In some examples, the header blocks can each include six pairs of mating protrusions. Each pair of mating protrusions of the six pairs of mating protrusions can have opposite mating protrusions extending from each side wall. The pairs of mating protrusions can be aligned with the cavities of the base blocks.

In some examples, the wall can include a header beam extending through the channel. The header beam can extend across at least two header blocks, through the back surface of a first header block of the two header blocks and through a front surface of a second header block of the two header blocks.

In some examples, the wall can further include a reinforcing material extending vertically through the cavities across rows of the base blocks. The reinforcing material can include a steel rod and concrete.

In some examples, the header blocks can be stacked over the base blocks such that for a majority of the header blocks, the header block is stacked directly on two base blocks.

In some examples, the header blocks can be stacked over the base blocks such that for the majority of the header blocks, the header block has about half of a length over each of the two base blocks.

In some examples, base blocks can each include connective components extending upward from the top surface of the base block. The bottom surface of the header blocks can each include recesses configured to receive the connective components of the base blocks. The connective components can be aligned vertically with the cavities.

In some examples, the bottom portion of the wall can include multiple rows of the base blocks stacked vertically. The top portion of the wall can include only one row of the header blocks.

The disclosed technology can include a header block including a polyurethane foam, a bottom surface comprising recesses configured to receive connective components of a base block, a front surface, a back surface, sidewalls, and an upward-facing channel positioned between the sidewalls.

In some examples, the back surface of the header blocks can each include surface features configured to engage with a front surface of an adjacent header block. The back surface of the header blocks and the front surface of the header blocks can each include a cutout shaped to a profile of the channel.

In some examples, the header block can further include six pairs of mating protrusions extending from a top surface of each of the sidewalls such that each pair of mating protrusions has an opposite mating protrusions extending from each side wall, and such that the six pairs of mating protrusions are regularly spaced across a length of the header block.

To the accomplishment of the foregoing and related ends, certain illustrative aspects are described herein in connection with the following description and the appended drawings. These aspects are indicative, however, of but a few of the various ways in which the principles of the claimed subject matter can be employed and the claimed subject matter is intended to include all such aspects and their equivalents. Other advantages and novel features can become apparent from the following detailed description when considered in conjunction with the drawings.

BRIEF DESCRIPTION OF THE FIGURES

The above and further aspects of this disclosure are further discussed with reference to the following description in conjunction with the accompanying drawings, in which like numerals indicate like structural elements and features in various figures. The drawings are not necessarily to scale, emphasis instead being placed upon illustrating principles of the disclosure. The figures depict one or more implementations of the inventive devices, by way of example only, not by way of limitation.

DETAILED DESCRIPTION

Figure 1A:
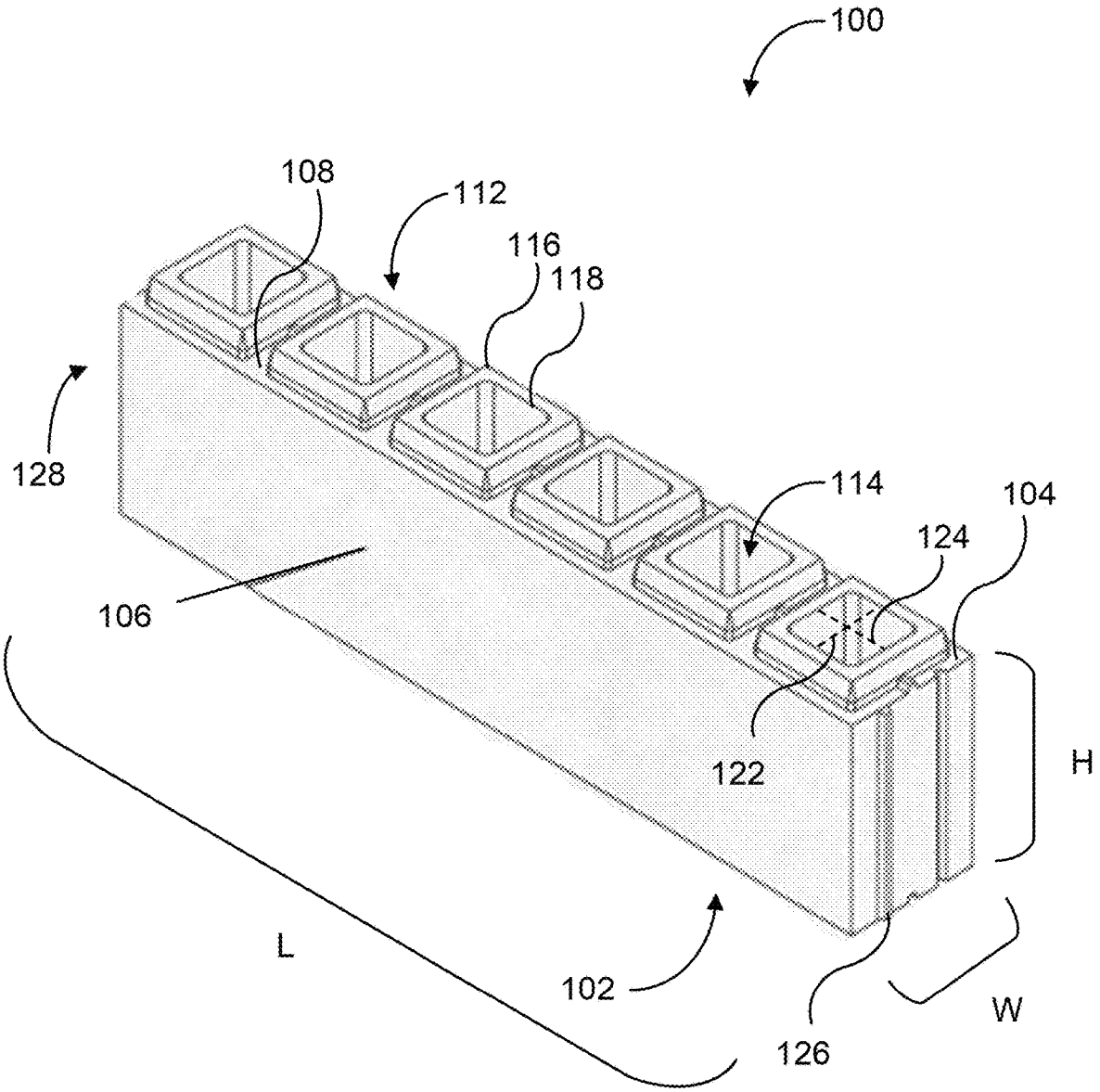
FIG. 1A illustrates a perspective top view of a polyurethane foam block, according to the present disclosure.

Although examples of the disclosed technology are explained in detail herein, it is to be understood that other examples are intended to be within the scope of the claimed disclosure. Accordingly, it is not intended that the disclosed technology be limited in its scope to the details of construction and arrangement of components set forth in the following description or illustrated in the drawings. The disclosed technology is capable of other examples and of being practiced or carried out in various ways.

It must also be noted that, as used in the specification and the appended claims, the singular forms "a," "an" and "the" include plural referents unless the context clearly dictates otherwise. By "comprising" or "containing" or "including" it is meant that at least the named compound, element, particle, or method step is present in the composition or article or method, but does not exclude the presence of other compounds, materials, particles, method steps, even if the other such compounds, material, particles, method steps have the same function as what is named.

As used herein, the terms "about" or "approximately" for any numerical values or ranges indicate a suitable dimensional tolerance that allows the part or collection of components to function for its intended purpose as described herein. More specifically, "about" or "approximately" can refer to the range of values ±10% of the recited value, e.g. "about 90%" can refer to the range of values from 81% to 99%.

In describing examples, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method can be performed in a different order than those described herein without departing from the scope of the disclosed technology. Similarly, it is also to be understood that the mention of one or more components in a device or system does not preclude the presence of additional components or intervening components between those components expressly identified.

Figure 1B:
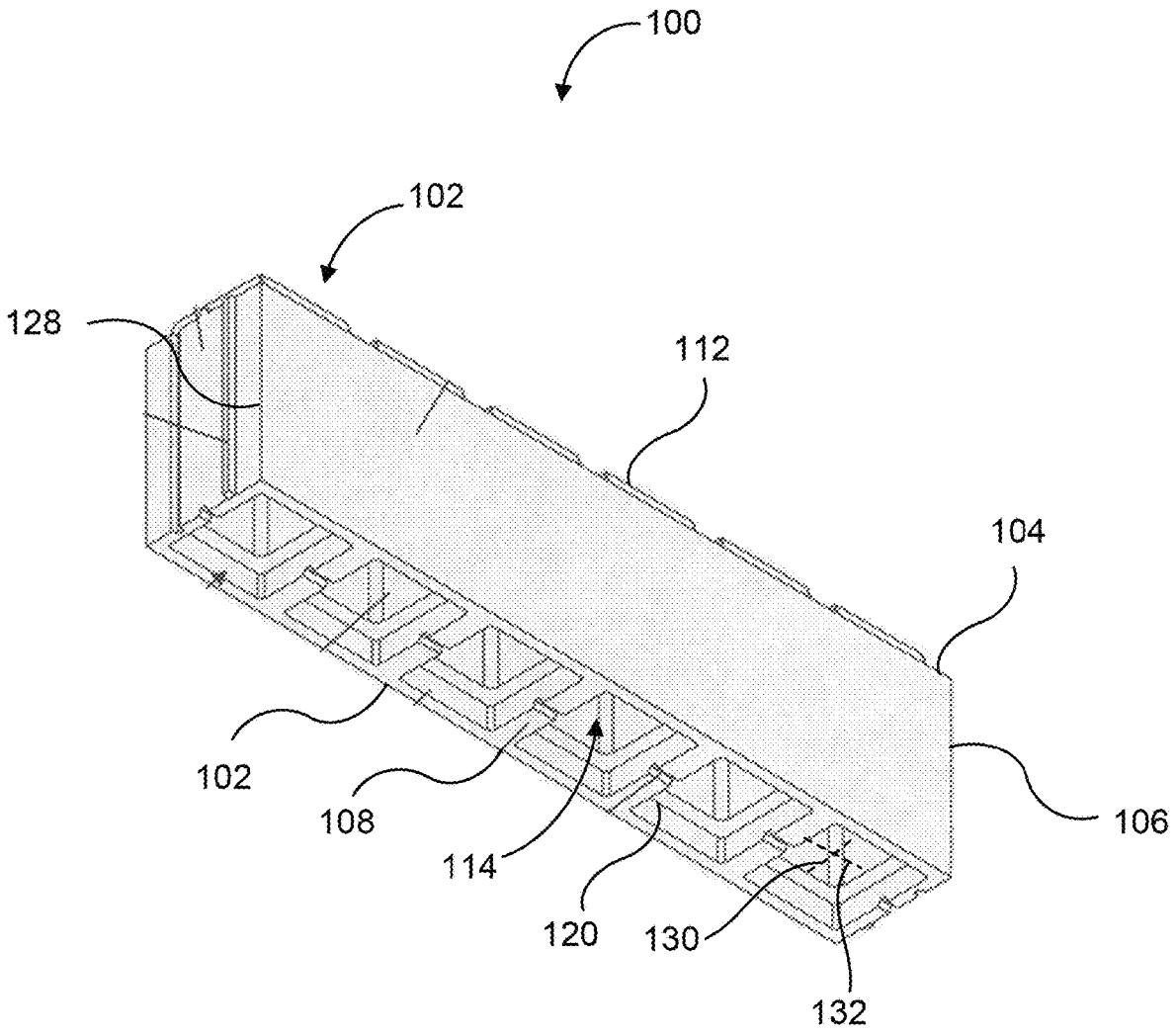
FIG. 1B illustrates a perspective bottom view of the polyurethane foam block of FIG. 1A, according to the present disclosure.
Figure 1C:
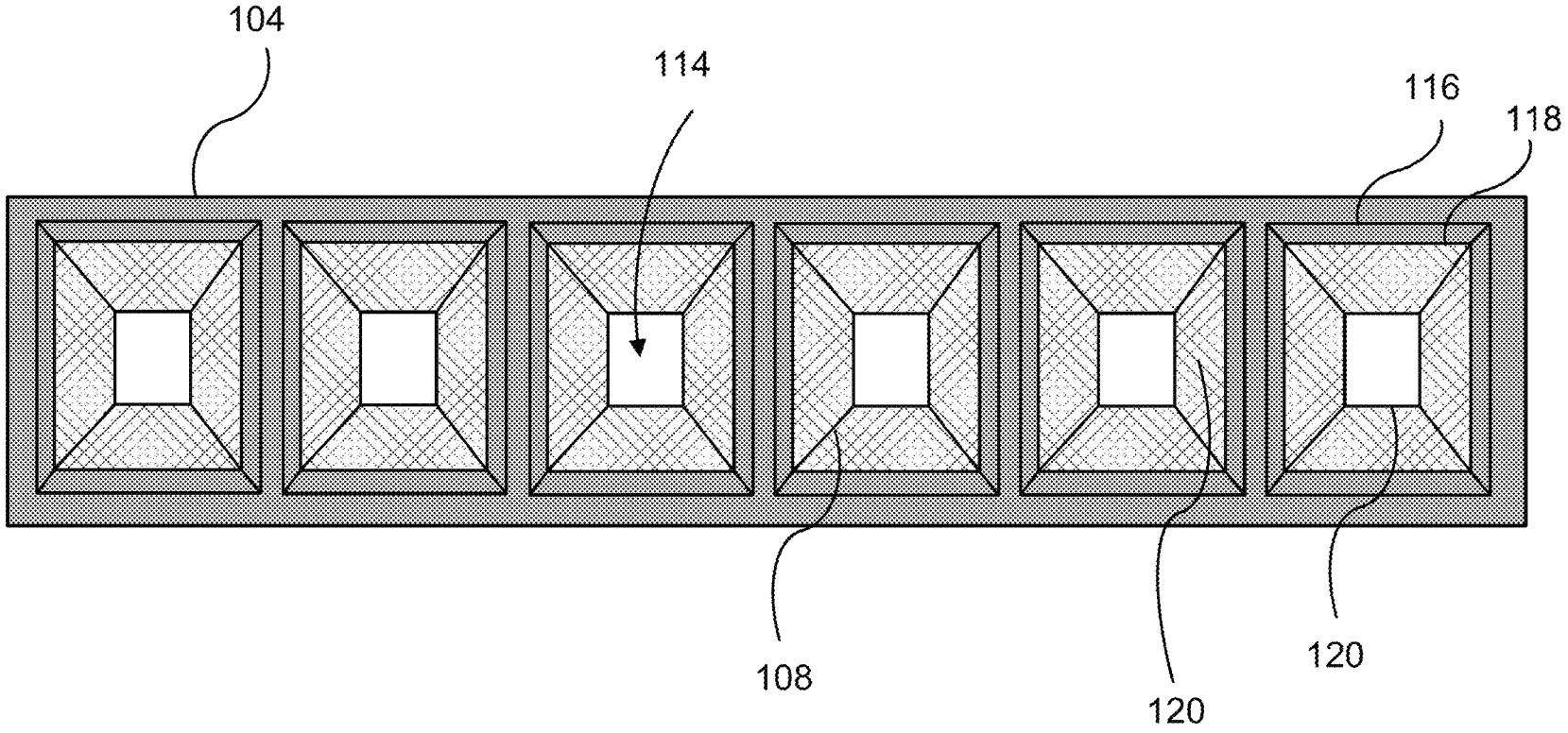
FIG. 1C illustrates a perspective side view of the polyurethane foam block of FIG. 1A, according to the present disclosure.

FIGS. 1A through 1C illustrate an example polyurethane foam block 100. FIG. 1A illustrates a perspective top view of the polyurethane foam block 100, FIG. 1B illustrates a perspective bottom view of the polyurethane foam block 100, and FIG. 1C illustrates a perspective side view of the polyurethane foam block 100. Referring collectively to FIGS. 1A through 1C, the polyurethane foam block 100 can include a bottom surface 102, a top surface 104, two sidewalls 106, a front surface 126, and a back surface 128. The sidewalls 106, the front surface 126, and the back surface 128 can extend from the bottom surface 102 to the top surface 104 and can define an interior of the polyurethane foam block 100. The polyurethane foam block 100 can have various geometries. The polyurethane foam block 100 can be substantially rectangular. The polyurethane foam block 100 can be substantially rectangular with rounded corners. Optionally, the polyurethane foam block 100 can be cuboid. The polyurethane foam block 100 can have a length L of between approximately three feet and approximately seven feet. The polyurethane foam block 100 can have a width W of between approximately eight inches and approximately fifteen inches. The polyurethane foam block 100 can have a height H of between approximately eight inches and approximately twenty inches. In one example, the polyurethane foam block 100 can have a height H of approximately twelve inches.

The sidewalls 106, the front surface 126, and the back surface 128 can each be substantially perpendicular to the bottom surface 102. Alternatively, the sidewalls 106, the front surface 126, and/or the back surface 128 can be substantially bevel. The sidewalls 106, the front surface 126, and/or the back surface 128 can be substantially flat. Alternatively, the sidewalls 106, the front surface 126, and/or the back surface 128 can include surface features, including protrusions, depressions, ridges, and/or the like. By way of example, as illustrated in FIG. 1A, the front surface 126 can include one or more surface features. As illustrated in FIG. 1B, the back surface 128 can similarly include such surface features. Such surface features can facilitate connecting polyurethane foam blocks 100 when forming various structural entities. The sidewalls 106, the front surface 126, and/or the back surface 128 can intersect at a ninety-degree angle (e.g., a sidewall 106 and the front surface 126 can intersect at a ninety-degree angle). In such configuration, the polyurethane foam block 100 can include sharp corners. Alternatively, the sidewalls 106, the front surface 126, and/or the back surface 128 can curve at the intersection with one another (e.g., between sidewall 106 and the front wall 126). In such configuration, the polyurethane foam block 100 can include rounded corners.

The polyurethane foam block 100 can include a plurality of partitions 108 extending from the bottom surface 102 to the top surface 104. The plurality of partitions 108 can divide the interior of the polyurethane foam block 100 into a plurality of cavities 114. Each cavity 114 can be configured to receive various materials to provide support for construction, including concrete and reinforcing bars.

The top surface 104 can include a plurality of connective components 112. The plurality of connective components 112 can protrude outwardly from the top surface 104 of the polyurethane foam block 100. The polyurethane foam block 100 can include any number of connective components 112. In one example, the polyurethane foam block 100 can include at least six connective components 112. Each connective component 112 can be spaced apart by a predetermined distance. By way of example, a center of a first connective component can be spaced apart from a center of an adjacent connective component by between approximately six inches and approximately ten inches. In one example, the center of the first connective component can be spaced apart from the center of the adjacent connective component by approximately eight inches.

Each connective component 112 can have a variety of geometries. By way of example, each connective component 112 can have a substantially frustoconical shape. A top surface 116 of each connective component 112 can include a cut-out portion 118. The cut-out portion 118 can have any cross-section shape. By way of example, the cut-out portion 118 can have a substantially square, rectangular, rectangular with rounded edges, circular, or polygonal cross-section shape. In one example, each cut-out portion 118 of the connective components 112 can have the same cross-section shape. Alternatively, the cut-out portions 118 of the connective components 112 can be different.

As illustrated in FIG. 1B, the bottom surface 102 of the polyurethane foam block 100 can include a plurality of recesses 120. Each recess 120 can align with a connective component 112 such that the cavity 114 defined by the plurality of partitions 108 can traverse therebetween. Each recess 120 can have substantially the same geometry and/or dimensions as each connective component 112. By way of example, if each connective component 112 includes a cut-out portion 118 that has a substantially square cross-section shape, each recess 120 can similarly have a substantially square cross-section shape of the same dimensions. In such configuration, a connective component 112 of a first polyurethane foam block 100 can interlock with a recess 120 of a second polyurethane foam block 100 when the second polyurethane foam block 100 is positioned on top of the first polyurethane foam block 100, as further discussed herein. Each recess 120 can be spaced apart by a predetermined distance. By way of example, a center of a first recess can be spaced apart from a center of an adjacent recess by between approximately six inches and approximately ten inches. In one example, the center of the first recess can be spaced apart from the center of the adjacent recess by approximately eight inches. However, other spacings greater or smaller are contemplated.

Each cut-out portion 118 and each recess 120 can have various dimensions. By way of example, each cut-out portion 118 can have a width 122 of between approximately four inches and approximately eight inches. In one example, each cut-out portion 118 can have a width 122 of 5.5 inches. Similarly, each recess 120 can have a width 130 of between approximately four inches and approximately six inches. In one example, each recess 120 can have a width of 5.5 inches. Each cut-out portion 118 can have a length 124 of between approximately four inches and approximately eight inches. In one example, each cut-out portion 118 can have a length of 5.5 inches. Similarly, each recess 120 can have a length 132 of between approximately four inches and approximately eight inches. In one example, each recess 120 can have a length 132 of 5.5 inches. The cavity 114 can be defined by approximately the dimensions of each cut-out portion 118 and each recess 120. The cavity 114 can traverse approximately the height H of the polyurethane foam block 100 and can be between approximately ten inches and approximately fifteen inches. In one example, the height H of the polyurethane foam block 100 can be approximately twelve inches. The cavity 114 can have a volume of between approximately 300 cubic inches and approximately 800 cubic inches. In one example, when the cut-out portion 118 has a width 122 and a length 124 of 5.5 inches, each recess has a width 130 and a length 132 of 5.5 inches, and the height H of the polyurethane foam block is 12 inches, the cavity 114 can have a volume of 363 cubic inches.

The dimensions of the cut-out portions 118 and the recesses 120 of the polyurethane foam block 100 can be larger than the prior art foam block created from EPS. The prior art foam block can thus require more foam material. Additionally, more concrete can be positioned within the cavities 114 of the polyurethane foam block 100 due to the dimensions of the cut-out portions 118, the recesses 120, and each cavity 114 as compared to the prior art foam block. Because foam can be more expensive than concrete, the prior art EPS foam block can result in higher construction costs than the polyurethane foam block 100. Similarly, EPS itself can be more expensive than polyurethane, resulting in additionally costs when using the prior art foam block instead of a polyurethane foam block 100.

The polyurethane foam block 100 can be made of a variety of types of polyurethane. By way of example, the polyurethane foam block 100 can include Elastopor® P53000R Resin/Elastopor® P1001U Isocyanate which can include a two-component polymeric MDI based system utilizing blowing agents with zero ozone depletion potential and ultra-low global warming potential. When the polyurethane foam block 100 includes Elastopor® P53000R Resin/Elastopor® P1001U Isocyanate, the polyurethane foam block 100 can exhibit various advantageous properties, including but not limited to, a parallel compressive strength of 37 psi at yield, a perpendicular compressive strength of 31 psi at yield, a parallel compressive modulus of 914 psi, and a perpendicular compressive modulus of 761 psi. Additionally, the Elastopor® P53000R Resin/Elastopor® P1001U Isocyanate can have a K-Factor of 0.183 BTU/in./hr./$ft^2$/° F., where K-Factor represents the material's thermal conductivity, and the lower the K-Factor, the better the insulation. Further, the Elastopor® P53000R Resin/Elastopor® P1001U Isocyanate can have a water absorption of 0.04 lbs/sq.ft, and can thereby resist structure deformation due to climate and/or weather conditions.

The polyurethane material used to create the polyurethane foam block 100 can provide the polyurethane foam block 100 a plurality of properties that can render the polyurethane foam block 100 advantageous. The polyurethane foam block 100 can be substantially resistant to moisture, as polyurethane can have a low moisture permeability value (e.g., approximately 1.2) as compared to other materials used in the construction industry. Although EPS can be moisture resistant to some degree, EPS can have slightly higher permeance rating of between 2.0 and 5.0. Because of the desire to greatly deter any mold or mildew, it can be beneficial to use polyurethane as the insulating material. Similarly, the polyurethane foam block 100 can substantially resist absorption of water, thereby allowing the polyurethane foam block 100 to maintain its structure and strength in any climate. Polyurethane can provide increased fire resistance as compared to EPS. Accordingly, the polyurethane foam block 100 can resist charring until a temperature of greater than 1,000 degrees Fahrenheit is reached. In contrast, EPS can become soft at 180 degrees Fahrenheit and melt at 240 degrees Fahrenheit. This difference can make polyurethane ideal for construction of buildings that must be fire resistant. The polyurethane foam block 100 can withstand a wind load of greater than approximately 150 miles per hour. EPS cannot withstand such high wind load, thereby providing an additional benefit of the polyurethane foam block 100. The polyurethane foam block 100 can have a thermal resistance of an R-value of greater than 4 per inch. It is understood that R-value is a measurement of how well a two-dimensional barrier (e.g., the polyurethane foam block 100) resists the conductive flow of heat. The greater the R value per inch of such two-dimensional barrier, the greater the insulating power. In one embodiment, the polyurethane foam block 100 can have an R-value of between approximately 5 per inch and approximately 6 per inch. In one embodiment, the polyurethane foam block 100 can have an R-value of approximately 5.5 per inch. This R-value can illustrate benefits unique to polyurethane, such as, when the polyurethane foam blocks 100 are stacked together to form a wall and/or structural entity as further described herein, the structural entity created can be well-insulated, thereby providing a comfortable and energy efficient for individuals working and/or living in the entity. Polyurethane foam blocks 100 with this R-value per inch can help lower the cost of heating and cooling the created structural entity, as a properly insulated entity created from such polyurethane foam blocks 100 can reduce heat flow such that less energy is used to heat the structural entity in the winter and cool it in the summer. This form of using energy more efficiently can ultimately lead to cost savings.

Figure 2:
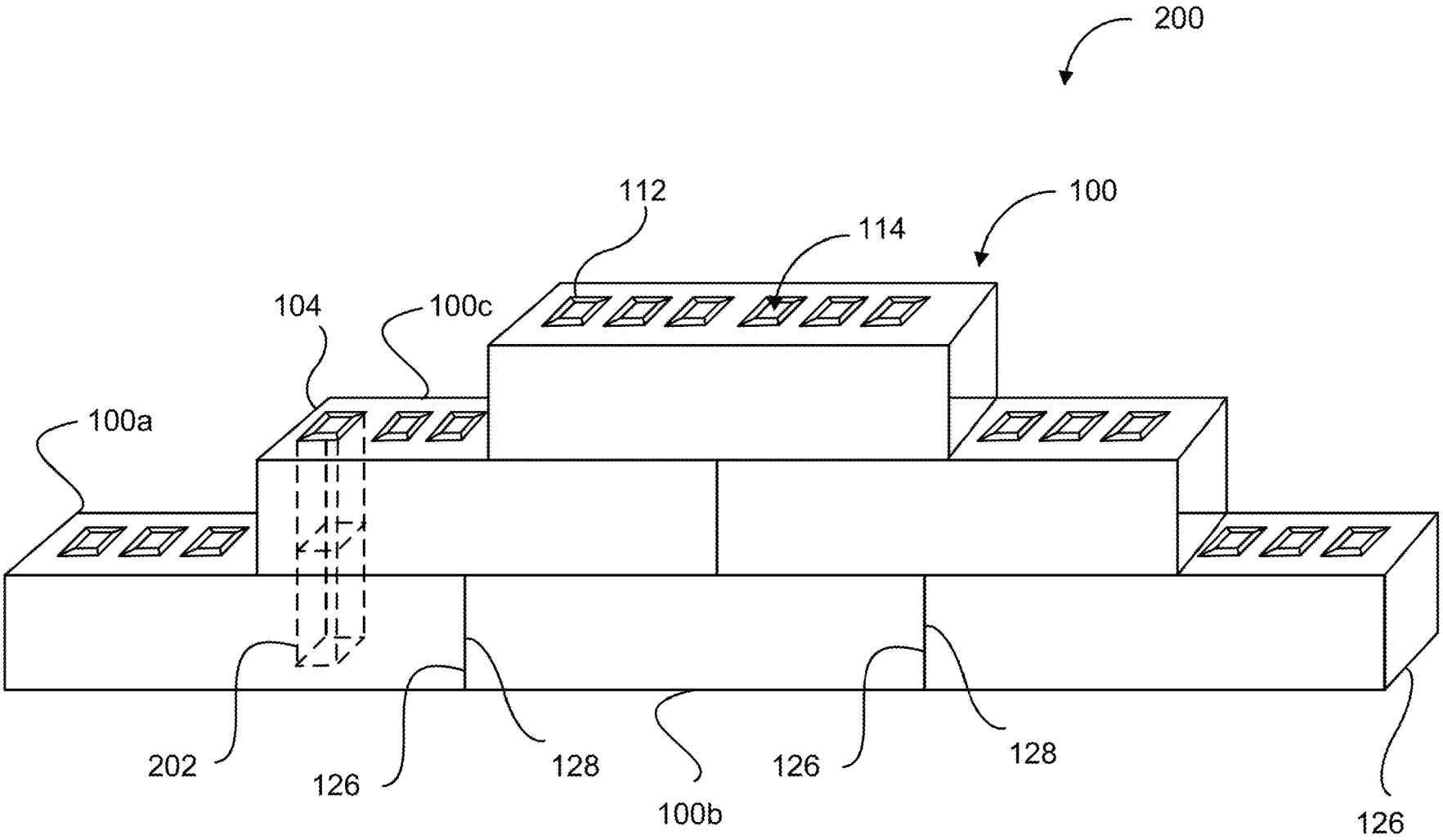
FIG. 2 is a schematic diagram of a wall formed by stacking polyurethane foam blocks, according to the present disclosure.

FIG. 2 illustrates a plurality of polyurethane foam blocks 100 configured to create a wall 200. Polyurethane foam blocks 100 can be positioned and stacked to build a variety of structural entities, including but not limited to, platforms, houses, garden walls, retaining walls, and commercial buildings. The wall 200 can include any number of polyurethane foam blocks 100. The polyurethane foam blocks 100 can be positioned and stacked to build the wall 200 of any target height. The target height can be determined based upon the height of the structural entity being built. By way of example, the wall 200 can have a height of at least five feet. In one example, the wall 200 can have a height of at least ten feet. In one example, the wall 200 can have a height of at least twenty feet. Additionally, the polyurethane foam blocks 100 can be positioned and stacked to build a wall 200 of any target length. The target length can be determined based upon the length and/or configuration of the structural entity being built. By way of example, the wall 200 can have a length of at least five feet. In one example, the wall 200 can have a length of at least ten feet. In one example, the wall 200 can have a length of at least twenty feet.

The polyurethane foam blocks 100 can be arranged such that the front surface 126 of one polyurethane foam block 100. is flush, aligned, and/or connected with the back surface 128 of an adjacent polyurethane foam block 100. The polyurethane foam blocks 100 can be stacked upon one another in a staggered manner. The connective components 112 of the polyurethane foam blocks 100 in the first row that is flush with a floor can interlock with the recesses 120 of the polyurethane foam blocks 100 positioned on top to create a second row. Any number of rows and/or polyurethane foam blocks 100 can be stacked to create the wall 200 of the desired height and length. The alignment of the connective components 112 and the recesses 120 can form an alignment of the cavities 114 traversing therebetween, as illustrated in FIG. 2, thereby creating an extended cavity 202 that can traverse a height of the wall 200.

Figure 3:
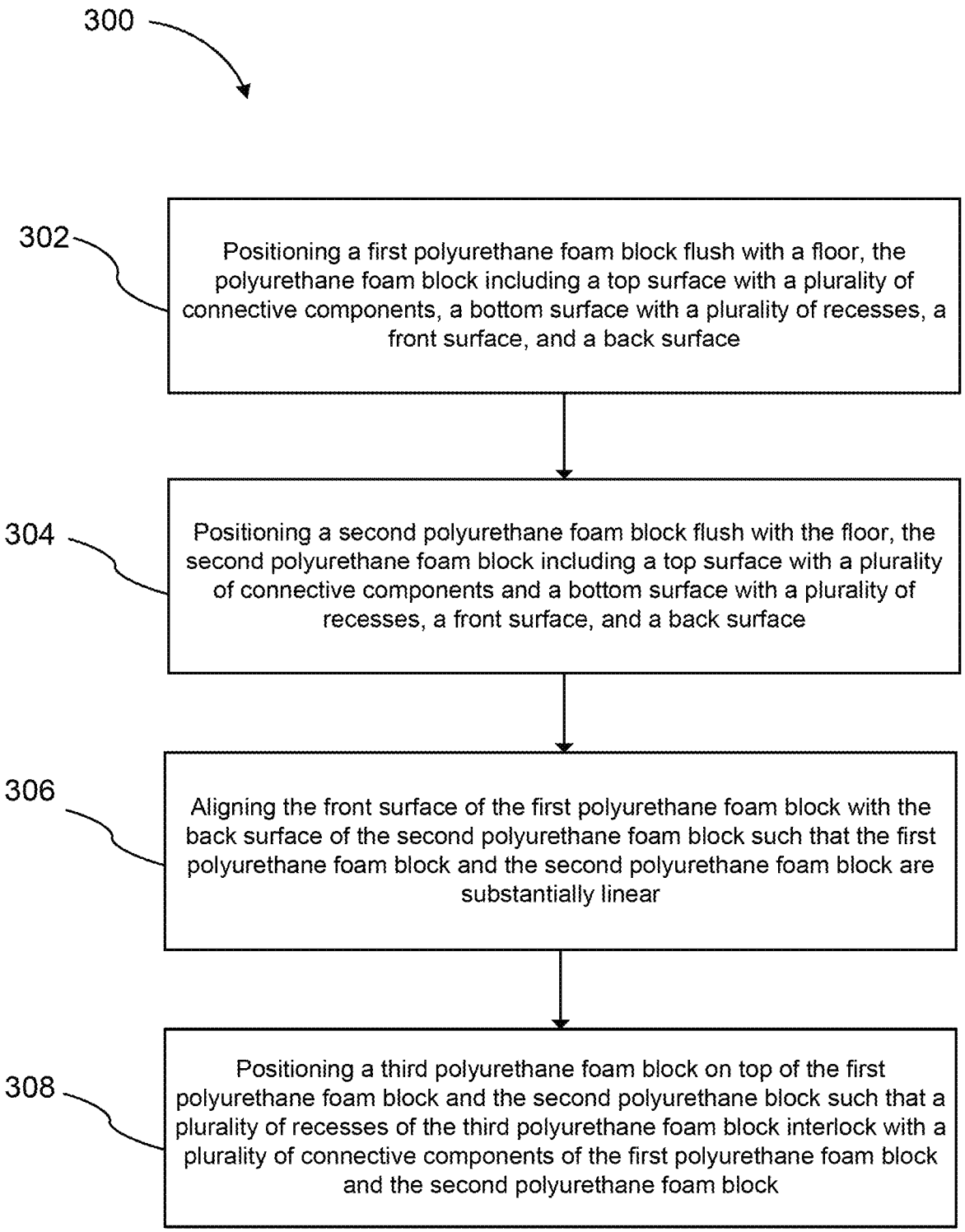
FIG. 3 is a flow diagram of a method of selectively stacking polyurethane foam blocks to create a wall, according to the present disclosure.

FIG. 3 illustrates an example method 300 of selectively stacking polyurethane foam blocks 100 to form the wall 200 and/or any other stationary structure. The method 300 of selectively stacking polyurethane foam blocks 100 can include positioning 302 a first polyurethane foam block 100*a* flush with a floor of a construction site. A construction site can be any location in which building or other stationary structure is built. By way of example, the construction site can be the location in which a wall, building, platform, or other structural entity is built. The first polyurethane foam block 100*a* can be positioned on the floor on the construction site with the top surface 104 facing upwards.

The method 300 can include positioning 304 a second polyurethane foam block 100*b* flush with the floor of the construction site with the top surface 104 of the second polyurethane foam block 100*b* facing upwards.

The method 300 can include aligning 306 the front surface 126 of the first polyurethane foam block 100*a* with the back surface 128 of the second polyurethane foam block 100*b*. In this configuration, the first and second polyurethane foam blocks are configured substantially linearly.

The method 300 can include positioning 308 a third polyurethane foam block 100*c* can on top of the first polyurethane foam block 100*a* and the second polyurethane foam block 100*b* such that the plurality of recesses 120 of the third polyurethane foam block 100*c* interlock with the plurality of connective components 112 of the first polyurethane foam block 100*a* and the second polyurethane foam block 100*b*.

The third polyurethane foam block 100*c* can be positioned on top of the first polyurethane foam block 100*a* and the second polyurethane foam block 100*b* in a staggered manner. By way of example, a first recess (e.g., the recess 120 closest to the back surface 128) of the third polyurethane foam block 100*c* can interlock with a second connective component of the first polyurethane foam block (e.g., the connective component 112 that is second closest to the back surface 128). Optionally, the first recess 120 of the third polyurethane foam block 100*c* can interlock with a fourth connective component of the first polyurethane foam block 100*a* such that a first half of the third polyurethane foam block 100*c* is positioned on top of the first polyurethane foam block 100*a* and a second half of the third polyurethane foam block 100*c* is positioned on top of the second polyurethane foam block 100*b*. This method 300 can be repeated until the target height and length of wall 200 and/or structural entity is reached.

In some instances, a polyurethane foam block 100 can be cut at a specific location in order to accommodate a location where a window, door, or the like will be upon completion of the wall 200 and/or structural entity. The polyurethane material of the polyurethane foam block 100 can facilitate creating such cut.

After the wall 200 and/or structural entity is created and/or during the process of forming the wall 200, concrete and/or other construction materials used for support can be poured into each extended cavity 202 allowing concrete to fill the extended cavity 202 traversing the height of the wall 200. Alternatively or in addition to, a reinforcing bar can be positioned within the extended cavity 202. The reinforcing bar can provide supplementary support to the wall 200 that can be built from a plurality of polyurethane foam blocks 100. The reinforcing bar can comprise steel or any other material with high durability and strength properties. In one example, concrete and/or other construction materials can be poured into every other extended cavity 202 upon at least a portion of the wall 200 being complete. In an alternative example, concrete and/or other construction materials can be poured into each extended cavity 202 upon at least a portion of the wall 200 being complete. Upon pouring the concrete and/or construction material, the wall 200 can continue to be built. The concrete and/or other construction materials poured into the extended cavities 202 can result in a durable and resilient wall 200 and/or structural entity. After the wall 200 and/or structural entity is completed, the wall 200 can be plastered, thereby creating a smooth exterior surface.

The created wall 200 and/or structural entity can be energy efficient, as the polyurethane foam blocks 100 can serve as insulation. In some examples, the polyurethane foam blocks 100 can meet R22 energy ratings.

The method 300 of stacking the polyurethane foam blocks 100 to create the wall 200 can occur at the construction site, as the polyurethane foam blocks 100 are lightweight and easy to lift, move, and/or arrange. Accordingly, the method 300 of stacking the polyurethane foam blocks 100 to create the wall 200 can occur in remote locations that have traditionally posed challenges for construction.

Figure 4A:
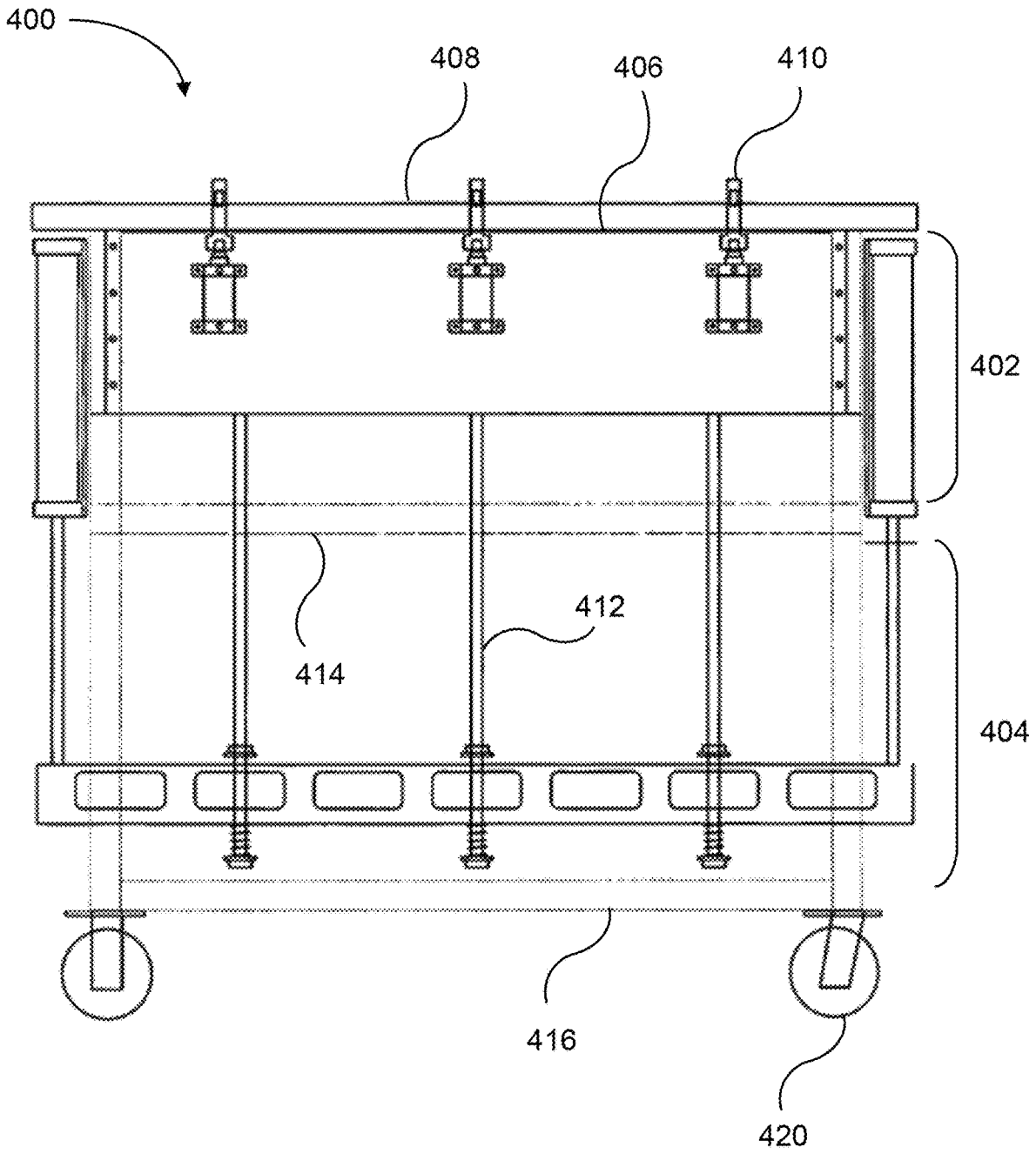
FIG. 4A is a front view of a portable molding device for creating a polyurethane foam block, according to the present disclosure.
Figure 4B:
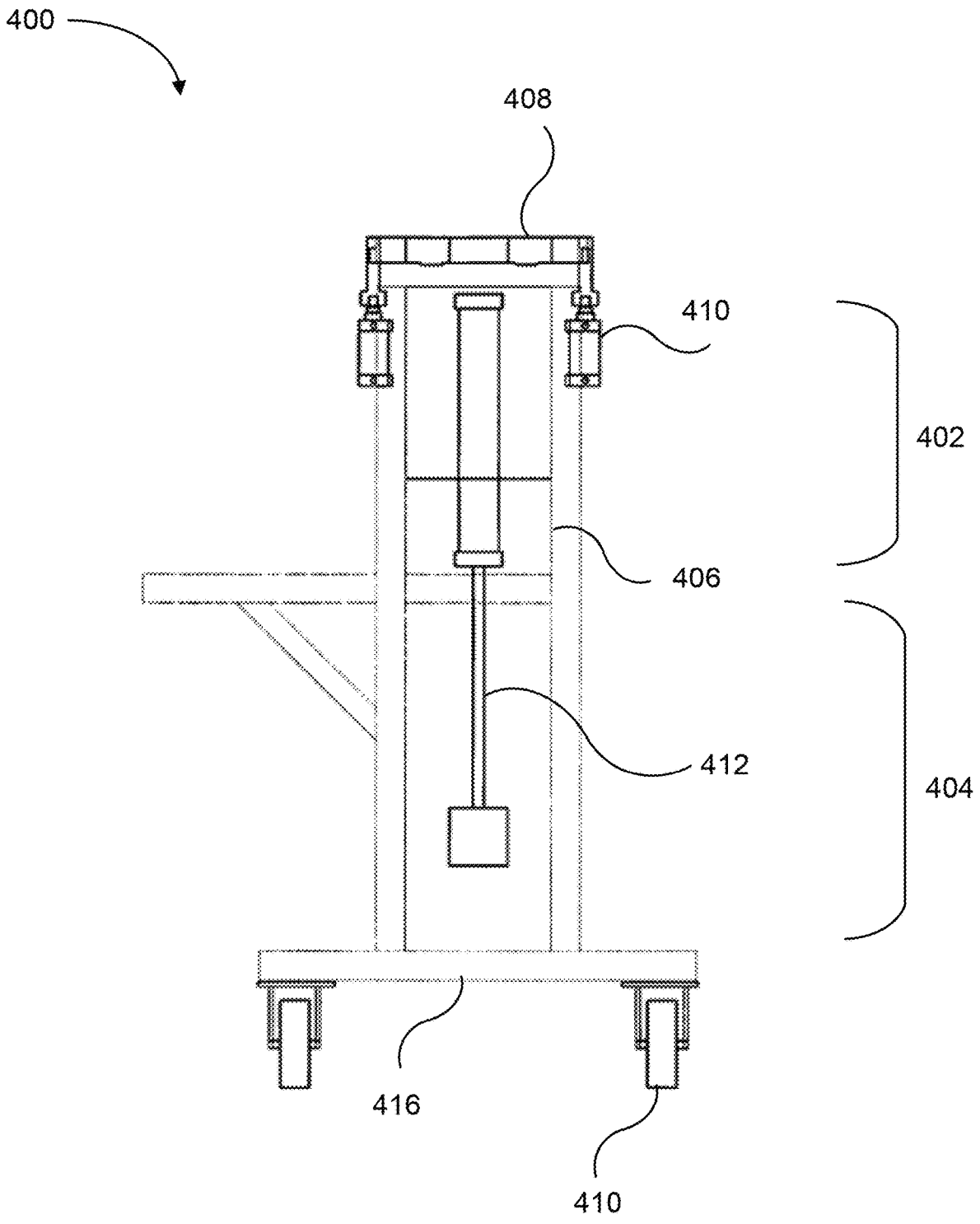
FIG. 4B is a side view of the portable molding device in FIG. 4A, according to the present disclosure.

FIGS. 4A and 4B illustrate an example portable molding device 400 used for forming the polyurethane foam block 100 and/or header block 610. By way of example, the portable molding device 400 can include the portable molding device as disclosed in U.S. Patent Publication No. 2018/0290332 to Ross et al., which is hereby incorporated by reference. FIG. 4A illustrates a front view of the portable molding device 400 and FIG. 4B illustrates a side view of the portable molding device 400. Referring collectively to FIGS. 4A and 4B, the portable molding device 400 can include an upper portion 402 and a lower portion 404. The upper portion 402 and the lower portion 404 can be divided by a platform 414.

The upper portion 402 can include a container 406. The container 406 can be configured to receive polyurethane. The container 406 can be sized based on the desired dimensions of the polyurethane foam block 100 and/or header block 610. A bottom surface of the container 406 can include surface features designed to form the plurality of recesses 120 of the polyurethane foam block 100 and/or header block 610.

Upon filling the container 406 with polyurethane, a lid 408 can be tightly sealed to the container 406 via one or more clamps 410 or other similar devices. Alternatively, the lid 408 can be hingedly coupled to the container 406. The lid 408 can include surface features (e.g., depressions, recesses, and/or the like). The surface features can facilitate forming of the plurality of connective components 112 of the top surface 104 of the polyurethane foam block 100. Additionally, or alternatively, the surface features of the lid 408 can facilitate forming mating protrusions 620 and channel 622 of the header block 610.

The container 406 of the portable molding device 400 can include one or more bevel side walls such that the polyurethane foam block 100 and/or header block 610 has corresponding bevel side walls. The bevel sidewalls can facilitate ejecting the polyurethane foam block 100 and/or header block 610 from the portable molding device 400.

The portable molding device 400 can include an extension device 412 to facilitate ejecting the polyurethane foam block 100 from the container 406 once the polyurethane has been cured. The portable molding device 400 can include wheels 420 or the like to facilitate portability. The wheels 420 can be used such that one or more users may move the portable molding device 400 without the need for large machinery, such as a crane, hydraulic or pneumatic lift systems, motorized vehicles, and/or the like. The wheels 420 can be coupled to a portion of the portable molding device 400 (e.g., the base 416 of the portable molding device 400).

Figure 5:
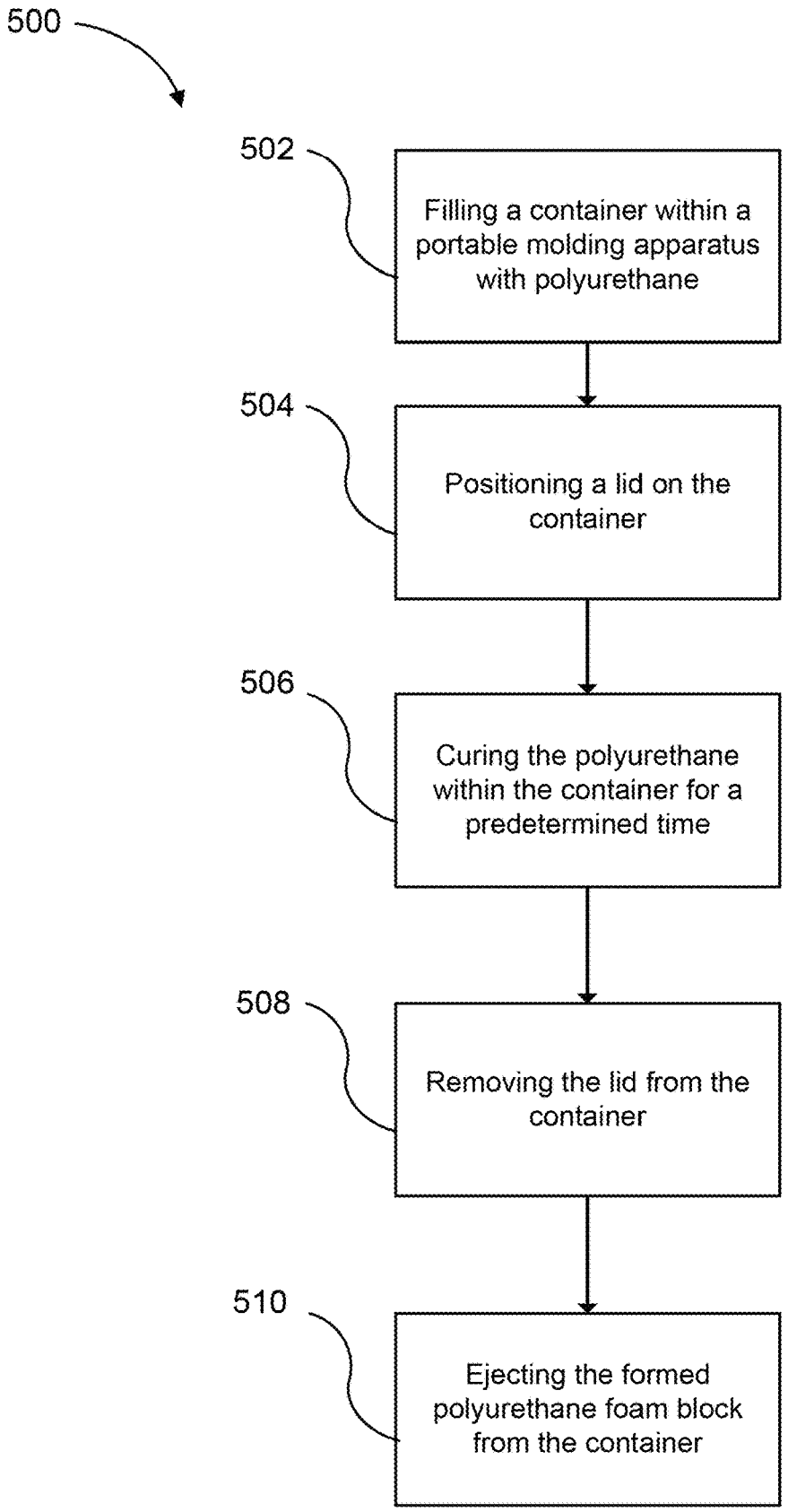
FIG. 5 is a flow diagram of a method of forming a polyurethane foam block using a portable molding device, according to the present disclosure.

FIG. 5 illustrates a flow diagram outlining a method 500 of forming the polyurethane foam block 100 using the portable molding device 400 according to various embodiments. The method 500 of forming the polyurethane foam block 100 can include filling 502 the container 406 within the portable molding device 400 with polyurethane. As discussed herein, the polyurethane can be any type of polyurethane.

The method 500 can include positioning 504 the lid 408 on at least a portion of the container 406.

The method 500 can include curing 506 the polyurethane for a predetermined time. The curing time for polyurethane can be between approximately five minutes and sixty minutes. In some embodiments, the predetermined time can depend on the type of polyurethane used to form the polyurethane foam block 100.

The method 500 can include removing 508 the lid 408 from the container 406 once the polyurethane has been cured.

The method 500 can include ejecting 510 the formed polyurethane foam block 100 from the container 406. In one embodiment, the formed polyurethane foam block 100 can be ejected using the extension device 412 that can cause the lower portion 404 of the portable molding device 400 to move in an upward direction to apply a force to the formed polyurethane foam block 100 within the container 406, such that the polyurethane foam block 100 is ejected.

The method 500 of forming the polyurethane foam block 100 can occur at a construction site, as the portable molding device 400 is portable and easy to maneuver due at least in part to the light weight of the device 400 and/or the addition of the wheels 420.

Because the polyurethane foam block 100 can be formed at the construction site, and subsequently stacked and arranged to form a wall via the method 300 as described herein, a number of structural entities can be built relatively easy and cost-effectively. Additionally, structural entities can be built in remote locations where building such structural entities has traditionally posed challenges. Accordingly, the polyurethane foam block 100 and the structural entities that can be formed by easily stacking the polyurethane foam blocks 100 can provide eco-friendly, affordable, strong, and safe structures around the world.

Figure 6:
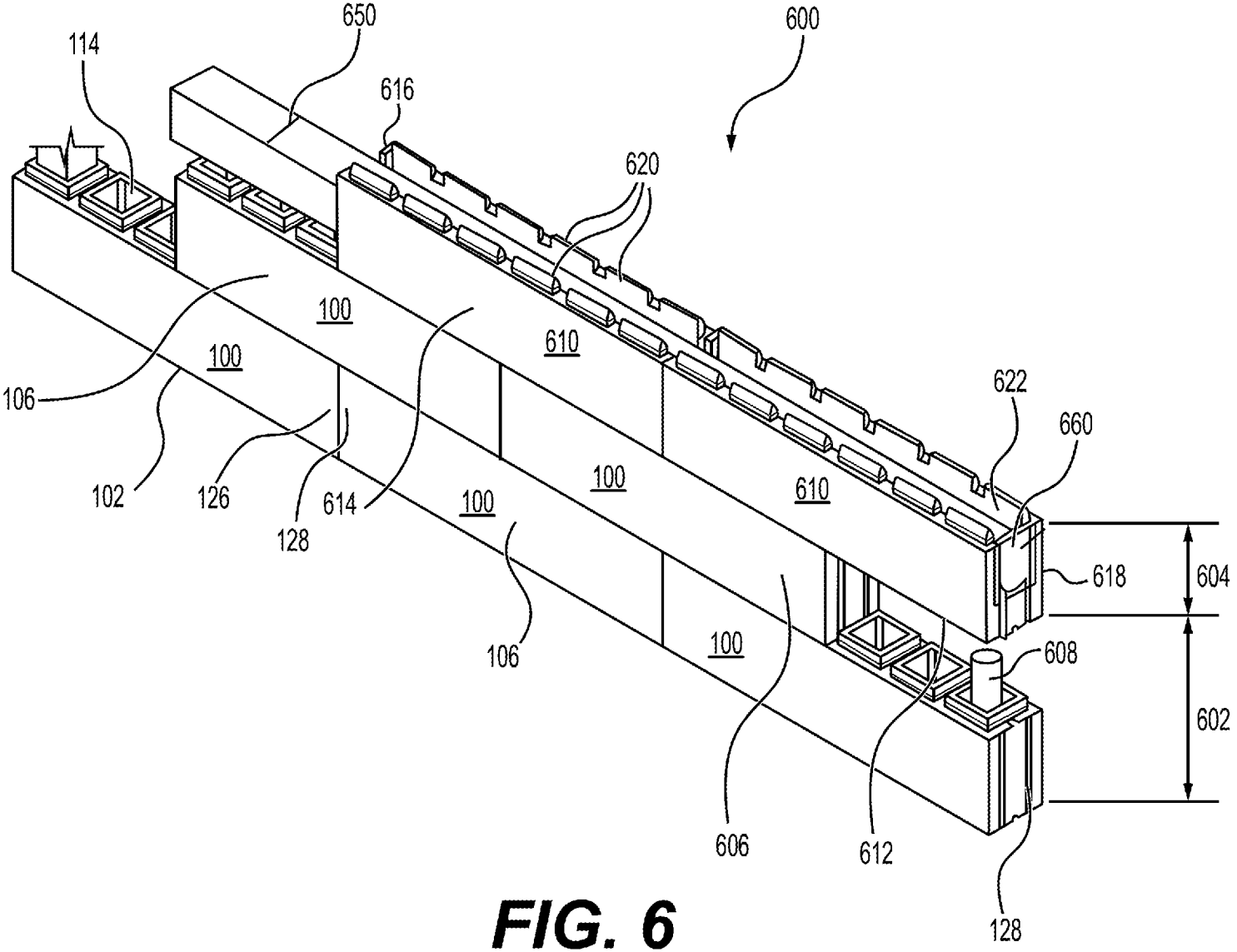
FIG. 6 is an illustration of a wall formed by stacking polyurethane foam blocks including header blocks, according to the present disclosure.

FIG. 6 is an illustration of a wall 600 formed by stacking polyurethane foam blocks including header blocks 610 and base blocks 100. The wall 600 can be configured to build a variety of entities, including but not limited to, platforms houses, garden walls, retaining walls, and commercial buildings. The wall 600 can be created by selectively stacking a plurality of base blocks 100 to form a bottom portion 602 of the wall 600 and selectively stacking a plurality of header blocks 610 on top of the base blocks, to form a top portion 604 of the wall 600. The header blocks 610 can be shaped similar to the base blocks 100 with one exception being that the header blocks include a cutout channel 622. The wall 600 can include a beam 650 sized to fit within the channel 622 to provide structural stability to the wall 600. The top portion 604 of the wall 600 can be configured to support a roof.

The base blocks 100 can each be configured similar to as disclosed elsewhere herein, such as illustrated in FIGS. 1A through 1C and 2, variations thereof, and alternatives thereto as understood by a person skilled in the pertinent art. The bottom portion 602 of the wall 600 illustrated in FIG. 6 can be constructed similarly to the wall 200 illustrated in FIG. 2. The bottom portion 602 of the wall 600 can be constructed using the base blocks 100 according to methods disclosed elsewhere herein, including method 300 illustrated in FIG. 3.

A header block can have a bottom surface 612, two sidewalls 614, a front surface 616, a back surface 618, mating protrusions 620 extending from a top surface of each of the two sidewalls 614, and an upward-facing channel 622 between the two sidewalls 614. The header block can have various geometries compatible to stack on top of the base blocks 100. The header block 610 can be substantially rectangular. The header block 610 can be substantially rectangular with rounded corners, or cuboid. The header block 610 can have a height H and a length L similar to the base block 100. The header block 610 can have a length L of between approximately three feet and approximately seven feet, a width W of between approximately eight inches and approximately fifteen inches, and/or a height H of between approximately eight inches and approximately twenty inches. In one example, the header block 610 can have a height H of approximately twelve inches.

The sidewalls 614, the front surface 616, and the back surface 618 can each be substantially perpendicular to the bottom surface 612. Alternatively, the sidewalls 614, the front surface 616, and/or the back surface 618 can be substantially bevel. The sidewalls 614, the front surface 616, and/or the back surface 618 can be substantially flat. Alternatively, the sidewalls 614, the front surface 616, and/or the back surface 618 can include surface features, including protrusions, depressions, ridges, and/or the like. As illustrated, the back surface 618 can include surface features of the header blocks 610 similar to the surface features on the back surface 128 of the base block 100. Likewise, the front surface 616 can include surface features corresponding to the surface features on the back surface 618 similar to the surface features on the front surface 126 of the base block 100. The surface features on the back surface 128 can be configured to engage with the front surface 616 of an adjacent header block 610.

As illustrated, the back surface 618 can include a cutout shaped to a profile of the channel 622 of the header block 610. Similarly the front surface 616 can include a cutout shaped to a profile of the channel 622. The front surface 616 and the back surface 618 of the header block 610 can be similarly configured to the front surface 126 and the back surface 128 of the base block 100 respectively with one exception being that the front and back surfaces 616, 618 include cutouts shaped to the profile of the channel 622 in the header block 610. The cutouts at the front surface 616 and the back surface 618 can be configured to allow a beam block 650 to extend across two adjacent header blocks 610, extending through a cutout of a back surface 618 of a first header block 610 and through a cutout of a front surface 616 of a second, adjacent header block 610.

At least one of the sidewalls 614 can be beveled to facilitate removal of the header from a block-molding device.

The top portion 604 of the wall 600 can have a height equal to a height of a header block 610.

The header blocks 610 can stacked on top of a top row 606 of base blocks 100 in the bottom portion 602 of the wall 600. The header blocks 610 can be stacked to form a top row of the wall 600. The bottom surface 612 of the header block 610 can therefore be configured similarly, or identically to the bottom surface 102 of the base block 100. Alternatively, the bottom surface 612 of the header block 610 can be alternatively configured while still being configured to mate with the top surface 104 of the base block 100. The bottom surface 602 of the header block 610 can include a plurality of recesses. Each recess can align with a connective component 112 of the base block 100. Each recess can have substantially the same geometry and/or dimensions as each connective component 112 of the base block 100. By way of example, if each connective component 112 includes a cut-out portion 118 that has a substantially square cross-section shape, each recess can similarly have a substantially square cross-section shape of the same dimensions. In such configuration, a connective component 112 of a base block 100 can interlock with a recess of a header block 610 when the header block 610 is positioned on top of the base block 100, similar to stacking of two base blocks 100 disclosed elsewhere herein. Each recess can be spaced apart by a predetermined distance. By way of example, a center of a first recess can be spaced apart from a center of an adjacent recess by between approximately six inches and approximately ten inches. In one example, the center of the first recess can be spaced apart from the center of the adjacent recess by approximately eight inches. However, other spacings greater or smaller are contemplated.

The mating protrusions 620 can be aligned vertically with connective components 112, and therefore cavities 114 of the base blocks 100. The mating protrusions 620 can be positioned in pairs, such that a mating protrusion 620 extending from one of the two sidewalls 614 has an opposite mating protrusion 620 extending as a mirror image from the other of the two sidewalls 614. The header block 610 can include six pairs of mating protrusions 620. The pairs of mating protrusions 620 can be vertically aligned with connective components 112, and therefore cavities 114 of the base blocks 100. Each pair of mating protrusions 620 can be spaced apart by a predetermined distance. By way of example, a center of a first pair of mating protrusions 620 can be spaced apart from a center of an adjacent pair of mating protrusions 620 by between approximately six inches and approximately ten inches. In one example, the center of the first pair of mating protrusions can be spaced apart from the center of the adjacent pair of mating protrusions by approximately eight inches. However, other spacings greater or smaller are contemplated. The mating protrusions 620 can have a tapered shape. The tapered shape can be similar in cross-section as a cross-section of a frustoconical connective component 112 of a base block 100.

The header block 610 can be made of a variety of types of polyurethane. By way of example, the header block 610 can include Elastopor® P53000R Resin/Elastopor® P1001U Isocyanate which can include a two-component polymeric MDI based system utilizing blowing agents with zero ozone depletion potential and ultra-low global warming potential. When the header block 610 includes Elastopor® P53000R Resin/Elastopor® P1001U Isocyanate, the header block 610 can exhibit various advantageous properties, including but not limited to, a parallel compressive strength of 37 psi at yield, a perpendicular compressive strength of 31 psi at yield, a parallel compressive modulus of 914 psi, and a perpendicular compressive modulus of 761 psi. Additionally, the Elastopor® P53000R Resin/Elastopor® P1001U Isocyanate can have a K-Factor of 0.183 BTU/in./hr./ft$^2$/° F., where K-Factor represents the material's thermal conductivity, and the lower the K-Factor, the better the insulation. Further, the Elastopor® P53000R Resin/Elastopor® P1001U Isocyanate can have a water absorption of 0.04 lbs/sq.ft, and can thereby resist structure deformation due to climate and/or weather conditions. The header block 610 may or may not be made from the same material as the base block 100. Polyurethane material used to create the header block 610 can have similar advantages as disclosed in relation to the base block 100.

The wall 600 can include a vertical structural support 608 which can be positioned to extend vertically through cavities 114 of stacked base blocks 100. The vertical structural support 608 can include a steel rod such as rebar. The cavities 114 of the base blocks 100 can further be filled with concrete to provide additional structural support to the wall 600.

Wall ends can include a beam stop insert 660 at the front surface 616, and/or the back surface 618 of the header block 610, which can inhibit the beam 650 from moving laterally within the channel 622 of the header block 610. The beam stop insert 660 can be positioned at ends of the wall 600 or at corners of a structure constructed with walls similar to the wall 600 illustrated in FIG. 6. The beam stop insert 660 can be positioned within a cutout of a front surface and/or back surface of a header block 610.

A header block 610 can be stacked on top of two base blocks 100. The header block 610 (e.g. right header block 610 in FIG. 6) can be staggered from a first base block 100 (e.g. right middle-row base block 100 in FIG. 6) by at least one connective component 112. In one embodiment, the header block 610 is positioned such that about half of its length is aligned over the first base block 100 and the other half of its length is aligned over a second base block 100 (e.g. middle, middle-row base block 100 in FIG. 6).

After a wall 600 is created, concrete can be poured into the cavities 114 of the base blocks 100, allowing concrete to fill the void traversing at least a portion of the height of the wall. One or more reinforcement bars 608 can also be positioned within the cavities 114. In one embodiment, one or more reinforcement bars 608 within the cavity 114 can traverse the height of the wall 600. Alternatively, the reinforcement bars 608 can traverse a height of the lower portion 602 of the wall 600.

FIG. 6 illustrates a plurality of polyurethane foam blocks 100, 610 configured to create a wall 600. In one embodiment, the plurality of polyurethane foam blocks 100, 610 can be configured to build a variety of entities, including but not limited to, houses, garden walls, retaining walls, and commercial buildings. The wall 600 can be created by selectively stacking a plurality of polyurethane foam blocks 100, 610. The method of selectively stacking the polyurethane foam blocks 100, 610 can include positioning a first polyurethane foam block 100 (e.g. right bottom-row base block 100 illustrated in FIG. 6) flush with the floor of the construction site with the upper surface 104 of the first polyurethane foam block 100 facing upwards. A second polyurethane foam block 100 (e.g. middle bottom-row base block 100 illustrated in FIG. 6) can be positioned flush with the floor of the construction site with the upper surface 104 of the second polyurethane foam block 100 facing upwards. A front surface 128 of the first polyurethane foam block 100 is aligned with a back surface 126 of the second polyurethane foam block 100. In this configuration, the first and second polyurethane foam blocks 100 are configured in a straight line. A third polyurethane foam block 100 (e.g. right middle-row base block 100 illustrated in FIG. 6) can be positioned on top of the first polyurethane foam block 100 and the second polyurethane foam block 100 in a staggered configuration.

In an embodiment, the third polyurethane foam block 100 is staggered from the first polyurethane foam block 100 by at least one connective component 112. In one embodiment, the third polyurethane foam block 100 is positioned such that half of its second plurality of connective components 112 are aligned with the first plurality of connective components 112 of the first polyurethane foam block 100 and half of its second plurality of connective components 312 are aligned with the first plurality of connective components 112 of the second polyurethane foam block 100. The first plurality of connective components 112 on the upper surface 104 of the first and second polyurethane foam blocks 100 can interlock with the second plurality of connective components 112 on the base 102 of the third polyurethane foam block 100.

The alignment of the connective components 112 of the stacked polyurethane foam blocks 100 creates an alignment of the cavities 114 of the polyurethane foam blocks 100 of the wall 600. This configuration allows for each cavity 114 of the polyurethane foam block 100 to traverse the height of the wall 600 formed. This configuration can facilitate stacking of a plurality of polyurethane foam blocks 100 to create a wall 600, as the process can be repeated until desired height and length are reached. In one embodiment, polyurethane foam blocks 100 can be positioned flush with the floor of the construction site to form a first row. A second row of polyurethane foam blocks 100 can be positioned atop the first row in a staggered manner, as illustrated in FIG. 6. Additional rows can be added in a staggered manner to facilitate interlocking of the connective components 112.

In one embodiment the wall 600 can be at least five feet tall. In one embodiment, the wall 600 can be at least ten feel tall. In one embodiment, the length of the wall 600 can be at least five feet long. In one embodiment, the wall 600 can be at least ten feet long. The ease of stacking the plurality of polyurethane foam blocks 100, 610 can allow the entire process to be completed at a construction site, as the polyurethane foam block 100 can be lightweight and easy to maneuver.

After a wall 600 is created, concrete can be poured into the cavities 114 of the polyurethane foam block 100, allowing concrete to fill the void traversing at least a portion of the height of the wall. One or more reinforcement bars 608 can also be positioned within the cavities 114. In one embodiment, one or more reinforcement bars 608 within the cavity can traverse at least a portion of the height of the wall 600. The concrete poured into the cavities 114 of the polyurethane foam blocks 100, 610 can result in a durable and resilient wall 600.

The process of manufacturing a polyurethane foam block 100, 610 can occur at the construction site, as the portable molding apparatus is portable and easy to maneuver. The process of stacking the polyurethane foam blocks 100, 610 to create a wall 600 can occur at the construction site, as the polyurethane foam blocks 100, 610 are lightweight and easy to couple due to the plurality of connective components 112 configured on the upper surface 104 of the base blocks 100 and base 102, 612 of each block 100, 610. The process of filling each cavity 114 with concrete can occur at the construction site. The combination of these processes can provide a method of creating affordable and resilient housing even in remote or inaccessible areas using polyurethane as a preferred material because of its advantageous properties.

The specific configurations, choice of materials and the size and shape of various elements can be varied according to particular design specifications or constraints requiring a system or method constructed according to the principles of the disclosed technology. Such changes are intended to be embraced within the scope of the disclosed technology. The presently disclosed examples, therefore, are considered in all respects to be illustrative and not restrictive. It will therefore be apparent from the foregoing that while particular forms of the disclosure have been illustrated and described, various modifications can be made without departing from the spirit and scope of the disclosure and all changes that come within the meaning and range of equivalents thereof are intended to be embraced therein.

What is claimed is:

1. A wall comprising:

a plurality of base blocks stacked to form a bottom portion of the wall, each of the base blocks having a respective block volume and comprising a bottom surface, a top surface, a front surface, a back surface, sidewalls, and cavities extending through each base block from the bottom surface of the base block to the top surface of the base block, the cavities being aligned vertically across rows of the base block and having a collective cavity volume of about 47% of the respective block volume, with each of the cavities having a width of about four inches to about eight inches; and a plurality of header blocks stacked on a top row of the base blocks to form a top portion of the wall, each of the header blocks comprising a bottom surface configured to mate with the top surface of the base blocks, a front surface, a back surface, sidewalls, and an upward-facing channel positioned between the sidewalls of the header block, wherein the base blocks and the header blocks are each composed of a polymer foam, and wherein the sidewalls of the base blocks and the sidewalls of the header blocks each have uniformly smooth exterior surfaces and the header blocks further comprise a plurality of mating protrusions each tapering towards an uppermost edge thereof.

2. A wall comprising:

a plurality of base blocks stacked to form a lower section of the wall, each of the base blocks comprising a bottom surface, a top surface, a front surface, a back surface, sidewalls, and six cavities extending through each base block from the bottom surface of the base block to the top surface of the base block, the cavities being aligned vertically across rows of the base blocks with each of the cavities having a width of about four inches to about eight inches; and a plurality of header blocks stacked on a top row of the base blocks to form a top portion of the wall, each of the header blocks comprising a bottom surface configured to mate with the top surface of the base blocks, a front surface, a back surface, sidewalls, and an upward-facing channel positioned between the sidewalls of the header block, wherein each of the header blocks comprise six mating protrusions extending from a top surface of each of the sidewalls, each of the six mating protrusions being vertically aligned with a respective cavity of the six cavities of the base blocks, wherein the mating protrusions of the header blocks each taper towards an uppermost edge thereof, wherein each of the base blocks comprise connective components extending upward from the top surface of the base block, wherein each bottom surface of the header blocks comprises recesses configured to receive the connective components of the base blocks, wherein the sidewalls of the base blocks and the sidewalls of the header blocks each have uniformly smooth exterior surfaces, and wherein the base blocks and the header blocks are each composed of a polymer foam.

3. The wall of claim 2, wherein the cavities of at least a first base block of the plurality of base blocks collectively have a volume of about 47% of a total volume of the first base block.

4. The wall of claim 2, wherein at least one of the cavities of a first base block of the plurality of base blocks has a first portion with a first width and a second portion with a second width different from the first width.

5. The wall of claim 4, wherein the first width is between about four inches and about eight inches and the second width is between about four inches and about six inches.

6. A wall comprising:

a plurality of base blocks stacked to form a bottom portion of the wall, each of the base blocks having a block width and comprising a bottom surface, a top surface, a front surface, a back surface, sidewalls, and cavities extending through each base block from the bottom surface of the base block to the top surface of the base block, the cavities being aligned vertically across rows of the base blocks and each cavity having a cavity width that is about half of the block width; and a plurality of header blocks stacked on a top row of the base blocks to form a top portion of the wall, each of the header blocks comprising a bottom surface configured to mate with the top surface of the base blocks, a front surface, a back surface, sidewalls, and an upward-facing channel positioned between the sidewalls of the header block, wherein each of the header blocks comprise mating protrusions extending from a top surface of each of the sidewalls that are vertically aligned with the cavities of the base blocks, wherein the mating protrusions of the header blocks each taper towards an uppermost edge thereof, wherein each of the base blocks comprise connective components extending upward from the top surface of the base block, wherein the sidewalls of the base blocks and the sidewalls of the header blocks each have uniformly smooth exterior surfaces, wherein each bottom surface of the header blocks comprises recesses configured to receive the connective components of the base blocks, and wherein the base blocks and the header blocks are each composed of a polymer foam.

7. The wall of claim 6, wherein the back surface of the header blocks each comprise surface features configured to engage with a front surface of an adjacent header block.

8. The wall of claim 6, wherein the header blocks each comprise six pairs of mating protrusions, wherein each pair of mating protrusions of the six pairs of mating protrusions comprises opposite mating protrusions extending from each header block sidewall, and wherein the pairs of mating protrusions are aligned with the cavities of the base blocks.

9. The wall of claim 6, wherein the recesses are aligned vertically with the cavities.

10. The wall of claim 6, wherein the bottom portion of the wall comprises multiple rows of the base blocks stacked vertically, and wherein the top portion of the wall comprises only one row of the header blocks.

11. The wall of claim 6, further comprising:

a header beam extending through the channel.

12. The wall of claim 11, wherein the header beam extends across at least two header blocks through a back surface of a first header block of the two header blocks and through a front surface of a second header block of the two header blocks.

13. The wall of claim 6, further comprising a reinforcing material extending vertically through the cavities across rows of the base blocks.

14. The wall of claim 13, wherein the reinforcing material comprises a steel rod and concrete.

15. The wall of claim 6, wherein the header blocks are stacked over the base blocks such that for a majority of the header blocks, the header block is stacked directly on two base blocks.

16. The wall of claim 15, wherein the header blocks are stacked over the base blocks such that for a majority of the header blocks, the header block is stacked directly on two base blocks.

17. The wall of claim 6, wherein the back surface of the header blocks each comprise a cutout shaped to a profile of the channel.

18. The wall of claim 17, further comprising:

a beam stop insert positioned at one or both of a front surface and a back surface of at least one of the header blocks within the cutout.

19. The wall of claim 18, wherein the beam stop insert is positioned at one or both of an end and corner of the wall.

* * * * *